United States Patent [19]

Petersen

[11] 4,352,671

[45] Oct. 5, 1982

[54] SHEET FOLDING APPARATUS FOR USE WITH CONTINUOUS WEB PRINTING MACHINE

[75] Inventor: Godber Petersen, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 187,542

[22] Filed: Sep. 16, 1980

[30] Foreign Application Priority Data

Sep. 12, 1979 [DE] Fed. Rep. of Germany ..... 2936768

[51] Int. Cl.[3] ..... B65H 45/16

[52] U.S. Cl. ..... 493/424; 493/428; 493/432; 270/6

[58] Field of Search ..... 493/424–433; 270/4–9

[56] References Cited

FOREIGN PATENT DOCUMENTS 236248 6/1945 Switzerland ..... 493/428

565365 11/1944 United Kingdom ..... 493/428

*Primary Examiner*—Richard J. Apley

*Assistant Examiner*—A. J. Heinz

*Attorney, Agent, or Firm*—Frishauf, Holtz, Goodman & Woodward

[57] ABSTRACT

To permit angular adjustment of a gripper system (51) on a pick-up cylinder with respect to the leading edge (c, d) of a sheet (b) of printed paper for folding intermediate the length thereof, for example in the center, by projecting a creasing blade (61') from a creasing mechanism (61) into a matching creasing groove (31) of a sheet receiving cylinder (3) as the sheet travels about the pick-up cylinder (2), the respective gripper and creasing blade systems (51, 61) are angularly adjustable about the central shaft (20) by support on end disks (52, 53, 62, 63) formed with camming surfaces in the shape of adjacently positioned rollers (56, 64; 55, 73) between which cone elements (81, 82) can be introduced, positioned radially offset from the axis of rotation so that, upon introduction of the cone elements and spreading of the respective rollers, angular rotation of the disks about the central operating shaft will result, thus positioning the respective disks angularly about the shaft in predetermined angular alignment. One of the camming surface rollers (73) can be coupled to a control arm (71) rotating under force of a drive motor (M, 41).

22 Claims, 5 Drawing Figures

SHEET FOLDING APPARATUS FOR USE WITH CONTINUOUS WEB PRINTING MACHINE

The present invention relates to a sheet folding apparatus, and more particularly to a sheet folding apparatus which is adapted for association with a continuous web printing machine, in which a continuous printed web is cut into sheets and the sheets are then transported to be gripped by a pick-up cylinder where they are creased for folding in, and further transport by, a sheet receiving cylinder.

BACKGROUND AND PRIOR ART

Various ways of folding sheets, and more particularly of sheets being continuously supplied from the printing machines, are known. In one such apparatus, the leading edge of a sheet is gripped by grippers positioned on the circumference of a sheet pick-up drum. The sheet pick-up drum is provided with a mechanism which includes a creasing blade which can protrude from the circumference of the pick-up drum when controlled to do so at a predetermined angular position. The pick-up drum is in running contact with the circumference of a sheet receiving cylinder which has a groove. The sheet receiving cylinder and the pick-up drum are driven in synchronism. The leading edge of the sheet, after having been gripped, is passed through the nip between the pick-up cylinder and the receiving cylinder. At the point of creasing, the creasing blade is caused to protrude from the pick-up cylinder at the instant of time when a creasing groove on the sheet receiving cylinder passes the nip, thus pushing a creased portion of the sheet into the groove of the sheet receiving cylinder which, upon release of the leading edge of the sheet from the pick-up cylinder, will then transport the folding sheet for further handling and conveying.

Apparatus of this type should be so designed that the leading edge gripper mechanism and the creasing blade mechanism can be relatively rotated along the circumferential position of the pick-up cylinder in order to accomodate sheets of different length, and still cause the crease to occur at the midpoint of the sheet, or at another predetermined longitudinal position thereof. It is thus desirable to be able to adjust the relative position of the sheet grippers and the creasing blade with respect to their relative circumferential position on the pick-up cylinder.

One type of known structure utilizes a split intermediate wheel or gear which, after loosening a screw connection, permits relative adjustment of the gears with respect to each other, permitting in turn rotation of the cutting cylinder which rotates a cutter blade to cut the web into sheets, and relative angular adjustment, further, of the creasing blade with respect to the grippers. It has been proposed to utilize an intermediate gear with helical gear teeth in order to permit fine adjustment, and so position the intermediate gear that its axial location on its shaft can be shifted, so that the spiral or helical gears will provide fine adjustment of angular positions. The adjustment obtained in this manner is smoothly continuous, that is, not in steps. Adjustment is done by hand. A considerable amount of skill as well as operating strength is required of the printing machine operator in order to effect proper adjustment.

Another way of providing rotary creasing and folding of a sheet and subsequent transport, while permitting relative adjustment, is shown in German Patent No. 739,360, in which the disadvantages of high skill and force requirements are intended to be avoided by use of a planetary gear drive. The planetary gear drive also permits smooth continuous adjustment of a creasing blade with respect to the grippers of the pick-up cylinder. This adjustment arrangement has the disadvantage that fine adjustment is difficult if the adjustment path or distance itself is small. Planetary gear drives, after only comparatively short operating time, tend to develop gear play, which results in inaccuracies in folding and creasing of the sheet. Additionally, planetary gear drives are noisy and wasteful of energy.

German Patent Disclosure Document DE-OS No. 21,57,615 illustrates an arrangement in which the adjustment between grippers and the creasing blade is so made that a dual intermediate wheel is provided in which the gear teeth have the same transmission ratio with respect to associated gears, and each gear wheel is connected with a rotating gear portion of a separate transmission gearing. The rotating gears of the transmission gearings are coupled together. The stator of one of the transmission gearings is fixed, the other stator, however, being adjustable angularly by a positioning motor or by hand. In accordance with this teaching, the gear transmissions— which are known as such—should have transmission ratios of, for example 160:161.

The folding device disclosed in this German Disclosure Document does not avoid the disadvantages mentioned above. They are reduced in part, but other difficulties arise. A planetary gear is still necessary which, in order to maintain the desired adjustment in operation, must rotate continuously. Planetary gears require additional bearings and gear engagement points, so that, as a final result, overall there is little improvement in the efficiency of operation or noise level. The aim in all printing—exact registration and reproducible operation—cannot be achieved upon extended operating time due to play and wear and tear in the gearing, and at the gear engagement points. The additional gear engagement locations, due to the multiple gears used in planetary drives, and the consequent small and hence rapidly rotating gears, cause an increase in operating noise. The folding device, in order to be adjustable, additionally requires substantial space. For complete adjustment of the format, it is necessary to utilize two of the devices as explained in the aforementioned German Disclosure Document, one for the gripper adjustment to adjust the gripper on the pick-up cylinder, and one for the creasing blade in order to position the creasing blade centrally of the sheet.

THE INVENTION

It is an object to provide a rotary sheet folding device for association with a continuously operating printing machine, and particularly with a continuous web printing machine into which a continuous web is cut which permits adjustment without play, which is low in operating noise, maintains freedom from play in operation and low noise, and in which wear and tear of the components is low; and which, preferably additionally, has high accuracy of adjustment and permits readjustment or reaction to correcting steps being taken during operation of the machine even if the correcting steps are small. The capability of correcting the position of the fold and/or the grippers, circumferentially, on a pick-up cylinder in operation, permits automatic readjustment and proper registration of sheets being fed to the apparatus while it is actually operating.

Briefly, the circumferential adjustment of the sheet edge grippers with respect to a creasing blade on a pick-up drum is effected by controlling the position of the grippers on the creasing drum by coupling them to a disk, rotating with the drum by a camming arrangement which is so constructed that the cams permit shifting of the grippers with respect to a fixed position even during rotation of the device. In accordance with a feature of the invention, the camming arrangement includes two adjacently positioned cam follower rollers, one secured to the rotating disk, and the other movable with respect thereto, between which rollers a wedge-shaped element is introduced. By positioning the wedge-shaped element, typically a cone, more or less between the rollers, the rollers are forced apart more or less, thus circumferentially shifting, respectively, the elements to which the rollers are attached. If one of the rollers is attached to the disk which is driven, and to the pick-up cylinder or drum as such, and the other roller to the gripper mechanism, it is seen that introducing the wedge-shaped element or cone between the rollers, more or less, will shift the position of the gripper mechanisms with respect to the roller which is secured to the cylinder or drum. The rollers are biassed towards each other by resilient force means, for example springs, and preferably gas-operated springs or dashpots.

Driving engagement of the gripper mechanisms—which, as such, are known and may be of any well developed and standard construction—with the drum thus can be controlled by moving the wedge-shaped, preferably conical element into or out of the space between the respective rollers forming the camming arrangement. The position of the wedge-shaped element can be controlled externally even during operation of the apparatus by connecting control gears to the conical elements which are operated by racks or the like connected to an external spindle pushing the racks in or out as desired, for example by a servo motor.

In accordance with a feature of the invention, forming a particularly desirable and simple construction, the drive shaft connected to a drive motor is a hollow shaft surrounding the central shaft which supports the sheet pick-up cylinder, at least in part, the drive shaft carrying the disk to which one of the camming rollers is attached. The hollow shaft has projecting arm on which one of the camming rollers is attached, the other camming roller, between which the wedge or conical engagement element is positioned, being secured to a control disk which can be shifted circumferentially or rocked with respect to the hollow shaft, and hence the projecting arm, to provide relative circumferential adjustment while also providing positive drive engagement between the control arm and the disk.

The arrangement has the advantage that the adjustment can be done without play, even during operation of the machine, since there is no gearing to engage in operation. The drive connection, once adjusted, is fixed, so that no gear or operating noises will result. Since there is no relative movement between the drive element, typically the control arm, and the pick-up drum, once the adjustment has been made, wear and tear of the engaged elements is effectively eliminated, while additionally positively eliminating any play, so that high accuracy in adjustment can be obtained, which adjustment is permanent and essentially unvarying.

The various pressure elements used, preferably, are fluid pressure springs, typically gas-loaded dashpots.

By making the wedge element in the form of cones, and the engaging elements in the form of rollers, engagement of the rollers with the cones will result in rolling engagement, rather than sliding engagement, thus reducing overall friction and hence resulting in minimum adjustment force being required.

In accordance with a feature of the invention, the wedge elements operate in a direction parallel to the axis of the pick-up cylinder or drum. Adjustment of the wedge elements then is carried out in axial direction. The wedge elements, having a fixed radial position from the axis of rotation of the drum thus, upon adjustment, do not result in a change of the rotating mass and of the out-of-center mass thereof, which can be balanced by appropriate balance weights, or arrangement of parts during manufacture. Thus, adjustment of the relative engagement position does not change the weight distribution of the apparatus, and hence does not result in unbalance forces or changeable unbalance forces.

The wedge elements, preferably, are conical or frustoconical. Utilizing conical wedge elements permits excellent fine adjustment while permitting rolling contacts between the engaging camming surfaces—also formed by rollers—and simultaneous adjustment of rollers positioned diametrically opposite each other with respect to the conical portions of the wedge elements.

More than one conical element may be provided in order to permit relative adjustment not only of grippers, but also of the creasing blade with respect to a predetermined reference position on the circumference of the pick-up drum. Thus, the crease position can be determined to fall not only exactly in the center of a sheet to be picked up, but rather off-center, if this is desired. Separate adjustment of the creasing blade with respect to the grippers and/or other components of the apparatus is thus possible.

More than one set of camming surfaces and wedge elements may be provided if the drum is of sufficient circumference to accomodate, for example, two cut sheets.

The grippers themselves can be located in a gripper assembly, as well known; the creasing blade can be located in a creasing assembly. In accordance with a feature of the invention, the respective assemblies are secured in end or face disks. One of them can be formed as a control disk, for example a disk supporting the folding blade. The gripper assembly is held in position by another disk adjacent the one retaining the creasing blade, with the respective rollers located on the respective disks. This results in a structurally simple arrangement requiring but few parts which are easily journaled for rotation, and permits a compact construction in which a plurality of gripper systems can be connected to the respective disk and the position of all the gripper systems can be controlled with respect to a number of creasing blades in a plurality of creasing assemblies, so that simultaneous adjustment, by a single wedge element, can adjust a plurality of gripper and creasing systems, circumferentially, with respect to a reference position on the drum. Thus, the arrangement is versatile and permits use in drums having a plurality of gripper and creasing blade assemblies to accomodate sheets along its circumference which are substantially shorter than the length of the circumference of the drum.

The apparatus can be so designed that one of the sides forms a drive side, in which the drive gears are located, and the other side—looked at axially—forms an operating or control side. This is a substantial advantage for operating safety since positioning motors—or possibly operator-controlled positioning wheels—can be placed remote from gearing and other potentially hazardous components of the apparatus.

The drive arrangement for the pick-up cylinder preferably includes a gear which is driven from a drive motor. This gear, in turn, is in engagement with gearing driving a sheet cutting apparatus and, additionally, the sheet receiving cylinder which receives the creased sheets in a receiving slot. Thus, when operating the entire assembly from a single drive motor—which is entirely possible in accordance with the arrangement—the severing apparatus to cut a continuous web into sheets and the subsequent transport and conveying apparatus beyond the sheet receiving cylinder will always operate in synchronism.

The respective movement of the various cylinders can be so arranged—by suitable choice of the position and the cone angle of the wedge-shaped elements and the associated rollers that the grippers move with respect to a reference position by a distance which is twice as long as the movement of, for example, the creasing blade, if it is desired to maintain the rear edge of a cut sheet always at the same position, and the crease or fold line in the center of the cut sheet. Thus, automatically and without further apparatus, it is possible to move the gripper system or gripper assembly in such a manner that no further adjustment of a severing or cutting cylinder is needed. The position of a cutting cylinder with respect to the pick-up cylinder thus need not be changed.

The present invention will be described in connection with a creasing and folding apparatus particularly adapted to receive a continuous web of printed material from a printing machine which, however, is not shown since it may be of any standard and well-known construction.

DRAWINGS

Figure 2:
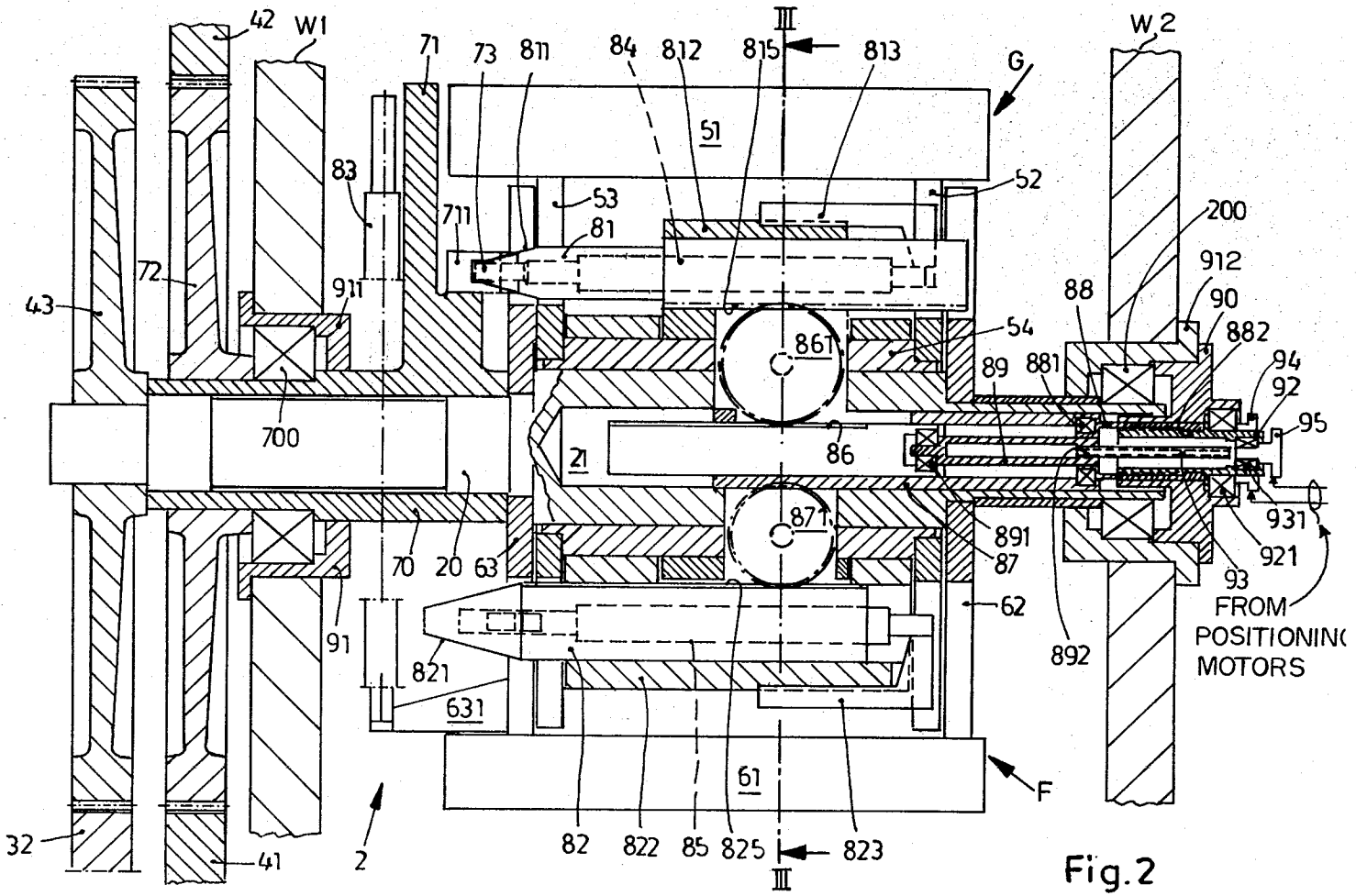
FIG. 2 is an axial, part-sectional view of the pick-up cylinder along line II—II of FIG. 3, to an enlarged scale.
Figure 3:
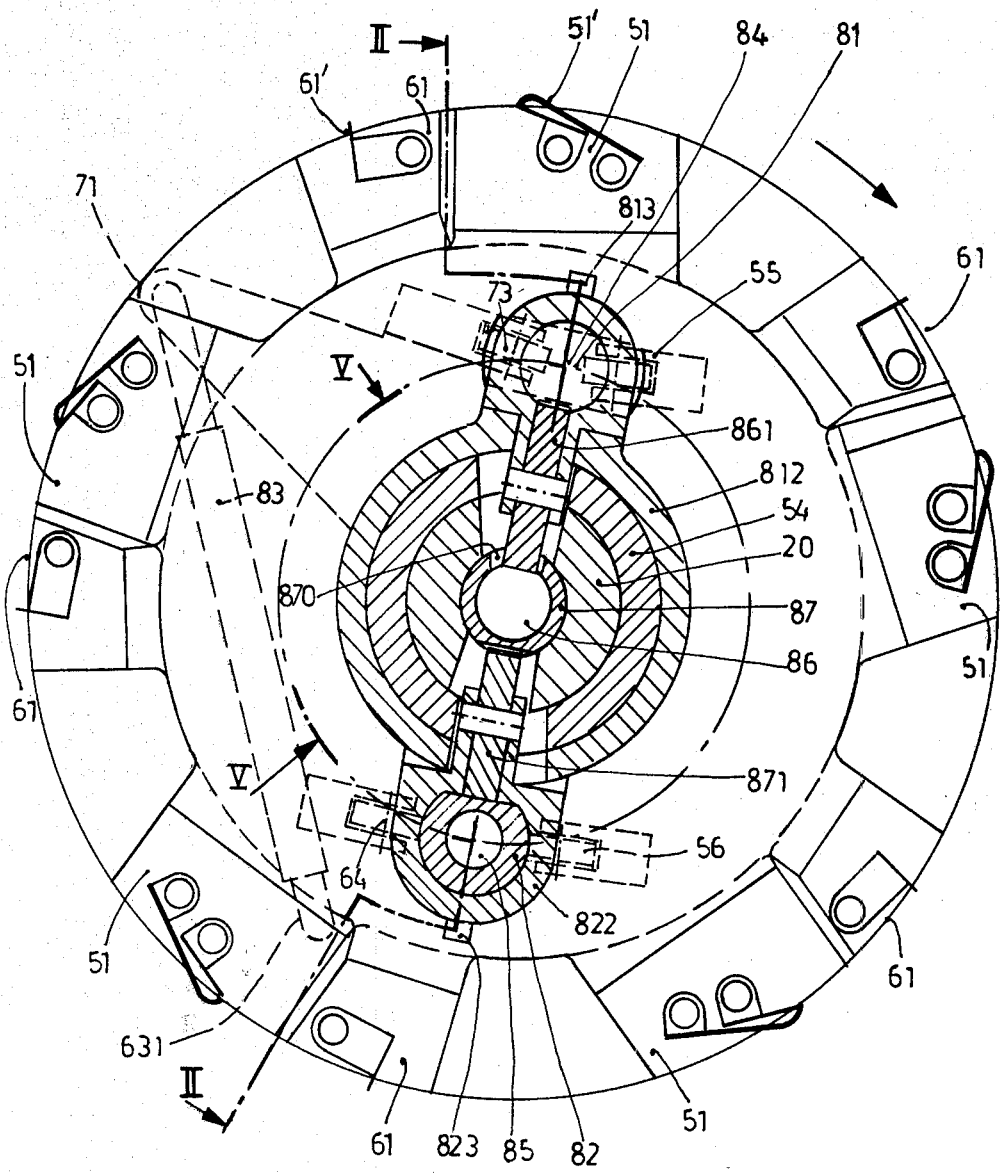
FIG. 3 is a diametrical view through the pick-up cylinder along line III—III of FIG. 2.
Figure 4:
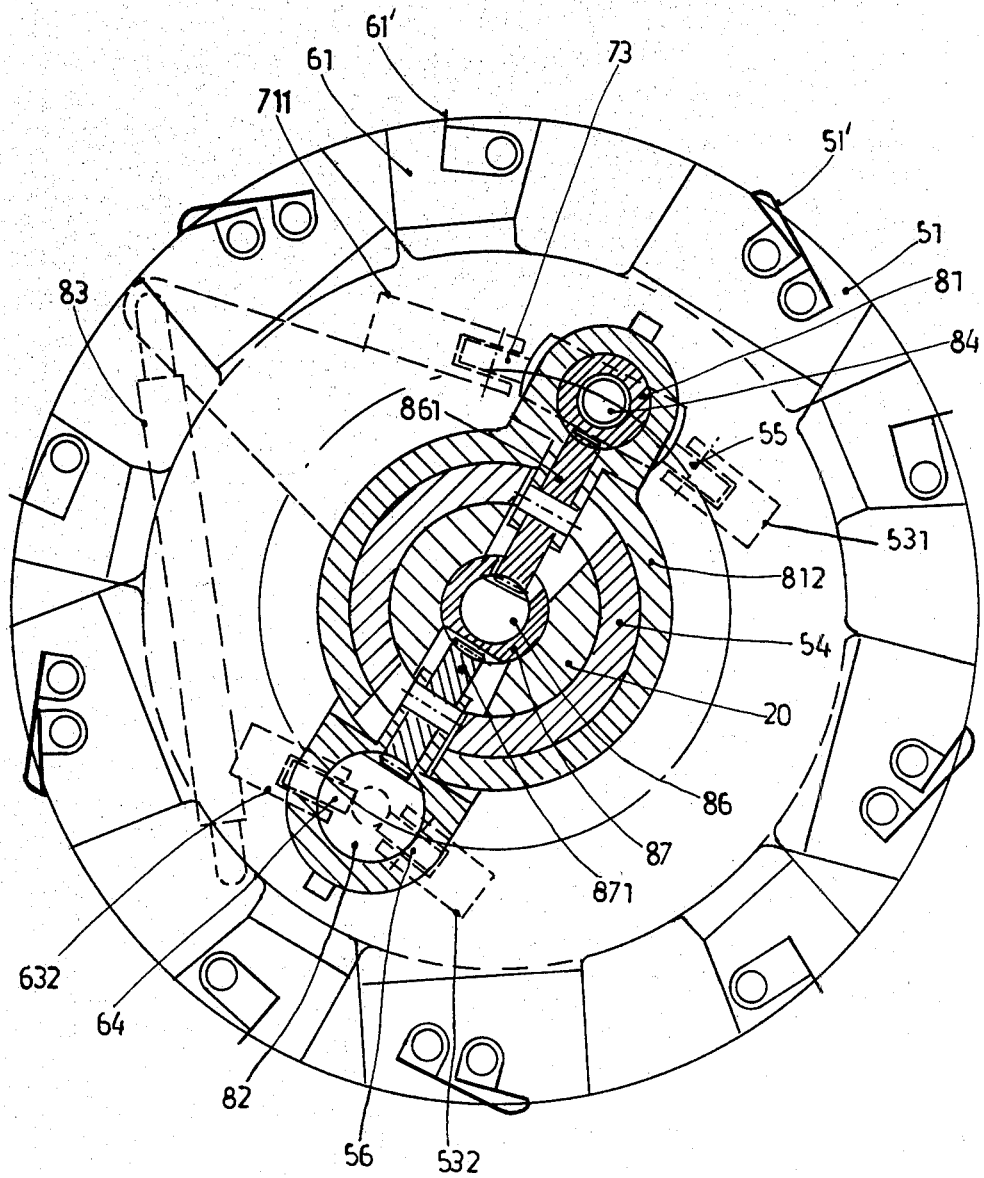
FIG. 4 is a diametrical view of the pick-up cylinder, but showing the pick-up cylinder in a different operating position.

It should be noted that FIGS. 1, 2, 3, 5 illustrate the pick-up cylinder and associate cylinders in the same position, FIG. 4 illustrating a shifted position.

Figure 1:
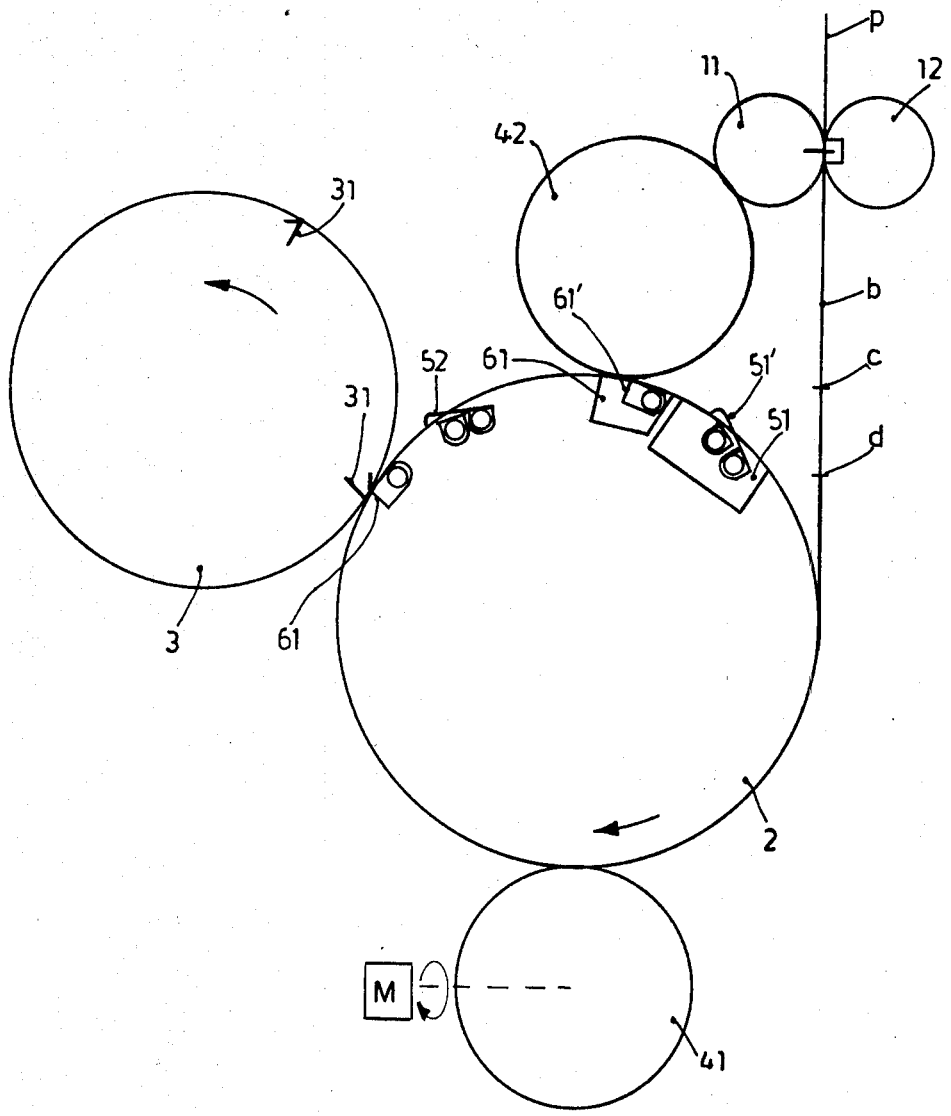
FIG. 1 is a highly schematic side view of the creasing and folding apparatus in accordance with the invention.

The folding arrangement—see FIG. 1—takes a paper web p from a printing machine, not shown, and passes the paper web through a rotary cutter cylinder 11, cooperating with a counter cylinder 12. The cut sheets b are then transported to a pick-up cylinder 2 where the leading edge is gripped by a gripper assembly 51, transported around the circumference of the cylinder 2 and, when the sheet at the fold position is opposite a folding groove 31 of a sheet receiving cylinder, a creasing blade from a creasing blade assembly 61 pushes an intermediate portion of the sheet—where it is to be folded—into the groove 31, where it is picked up by the sheet receiving cylinder for further transport in folded condition. The grippers of the gripper assembly 51 release the sheet when it is pushed into the receiving slot 31. The assembly is driven by a drive motor M which drives a gear 41, meshing with a gear 72 (FIG. 2, and not shown in FIG. 1 for simplicity) on the pick-up cylinder 2. The gear 72 meshes with the gear 42 with, in turn, drives the cutter cylinder 11. Synchronized operation of all the drums is thus insured. The front edge of the sheets b, cut from the web p, will appear, depending on the length of the sheet to be severed, or format thereof, at lines c or d, respectively, for gripping by gripper 61' of the gripper assembly 61, and later folding by folding blades 61' of the folding assembly 61. The folding assemblies and the folding blades, as well as the gripper assemblies and the grippers themselves are well known and may be of any standard and suitable construction, and not shown in greater detail. The fold in the sheet need not be in the center, it may be slightly offset with respect thereto, to form an overlap. More than one gripper assembly 51 and more than one folding assembly 61 can be located on the pick up cylinder, and more than one folding receiving groove 31 may be placed on the sheet receiving cylinder, as well known. To permit folding sheets of different lengths, or different format, respectively, and fold them at a predetermined fold line, for example in the center each time, it is necessary to adjust the circumferential position of the gripper assembly 51 and of the folding assembly 61 circumferentially about the shaft of the pick-up cylinder 2. The present invention is concerned with the arrangement to permit such adjustment.

In accordance with a feature of the present invention—see FIG. 2—the shaft 20 supporting the pick-up cylinder 2 has an end portion over which a hollow cylindrical shaft 70 is journaled. The shaft 20, with the hollow shaft 70 thereover, is journaled in the end walls W1 and W2 of the apparatus in suitable bearings 200, 700, seated in bearing bushings 911, 912. Roller bearings or ball bearings are suitable.

The folding blade assemblies 61 are supported on the shaft 20 by end disks 62, 63. One of the end disks, disk 63, at the same time forms a controller or camming element. The folding blade assembly 61, the supporting end disks 62, 63, together with the cylinder shaft 20, form the folding system F.

The gripper assemblies 51 are secured by two end disks 52, 53, between which the gripper assemblies 51 are positioned. One of these end disks, disk 53, simultaneously forms a control or camming disk. Disks 52, 53 are positioned on a hollow shaft 54, which is rotatable or rockable with respect to the shaft 20. The gripper assemblies 51, end disk 52, control or camming end disk 53 and hollow shaft 54 together form the gripper system G.

The hollow cylindrical shaft 70 is secured to the gear 72 which meshes with the drive gear 41, driven by the motor M. Gear 42 connects the gear 41, and hence the motor and the gear 72 with the cutter cylinder 11 for synchronous rotation and maintenance of respective angular position. The main cylindrical shaft 20 has a gear 43 secured thereto which is in engagement with the gear 32 driving the folding sheet receiving cylinder 3 (FIG. 1).

Figure 5:
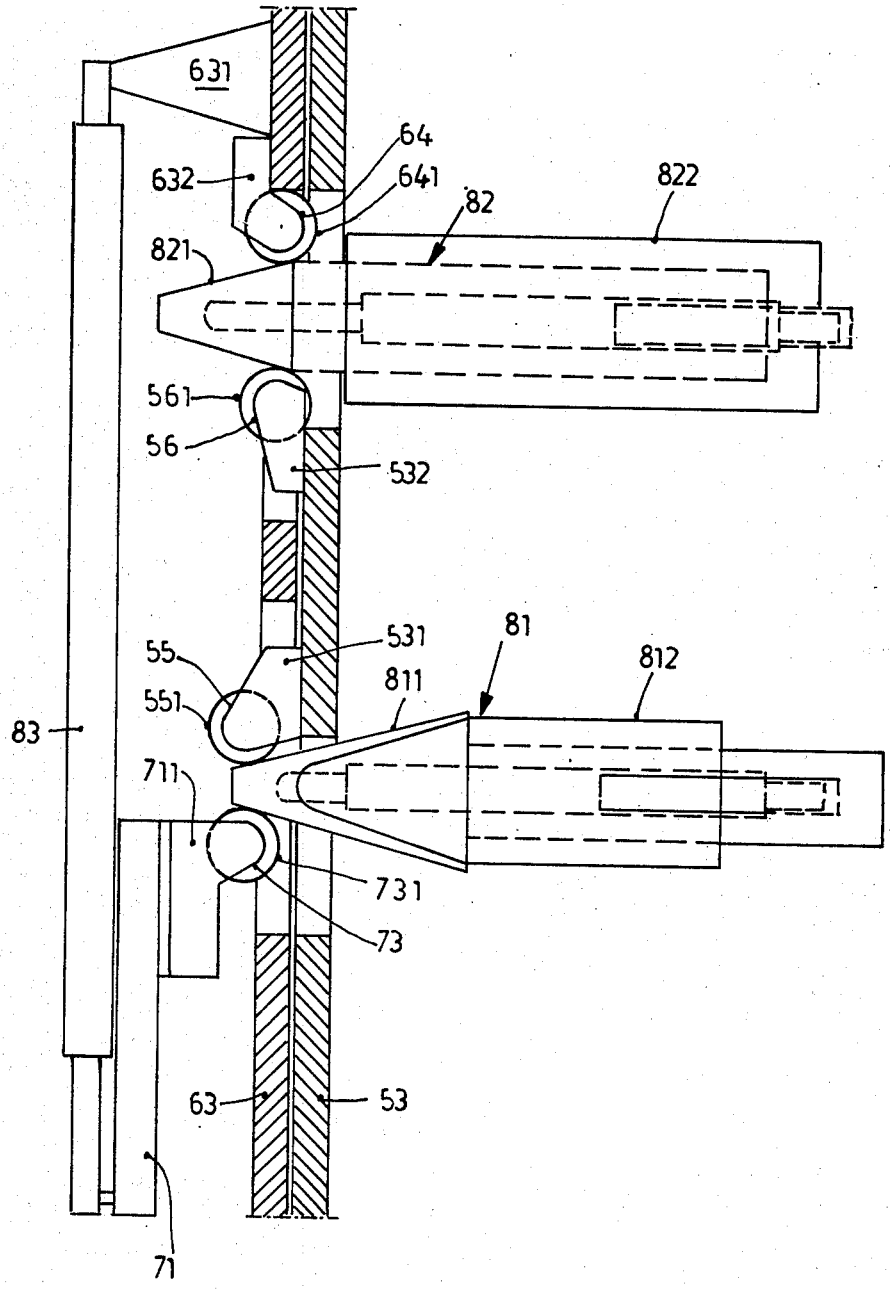
FIG. 5 is a schematic, fragmentary developed view, to a different scale, of a section taken along line V—V of FIG. 3.

A control arm 71 is secured to the hollow shaft 70 (see FIGS. 2 and 5). The camming or control disk 63 is coupled to the control arm 71 by a resilient spring force element 83, which is secured at its ends, respectively, to disk 63 by a bracket 631 and by a suitable connection, for example a pivot pin, to the control arm 71. The force element 63 preferably is a gas spring or sealed gas dashpot.

As best seen in FIGS. 2–4, and particularly in FIG. 5, control arm 71 has a bracket 711 attached thereto on which a roller 73 is journaled, the surface of which forms an engagement camming surface 731. The roller 73 can be coupled with a roller 55 secured by a holder 531 by engagement of the circumference 551 of the roller 55 with the surface 811 of a wedge element 81 (see FIG. 5). The control disk 53 has a bracket 532 attached thereto on which a roller 56 with a surface 561 is journaled. The surface of the roller 56 can be coupled with the control disk 63 by the surface 641 of roller 64, secured by a bracket 632 on the disk 63, upon engagement of the conical surface 821 of the wedge element 82 between the respective rollers 56, 64. The wedge elements 81, 82 have approximately conically shaped engagement surfaces 811, 821 in the region of their engagement with the surfaces 551, 561, 641, 731 of the respective rollers 55, 56, 64, 73. The wedge elements or, rather, the conical elements, are retained in housings 812, 822 (FIGS. 2 and 5) and are movable in a direction parallel to the axis of shaft 20. They are retained in respective positions by force elements, preferably gas springs 84, 85 which are secured by holders 813, 823 (FIG. 2), attached to the housings 812, 822, respectively, and applying pressure in the direction of the rollers 55, 56, 64, 73.

Two independently adjustable or drivable racks 86, 87, which can be pivoted over their longitudinal axis, are positioned in a bore 21 of the shaft 20. The bore 21 is placed adjacent the cylinder elements 81, 82. The racks 86, 87 are cylindrical at their outer circumference and are telescoped one within the other, the rack 86 being guided within the rack 87. The wedge element housings 812, 822 each pivotally retain a gear 861, 871 which is in engagement with a respective rack 86, 87 and engages, respectively, a matching rack 815, 825 on the wedge element 81, 82. The shaft 20 and the hollow shaft 54 are formed with longitudinal slots to permit lateral play and engagement of the respective gears through the shafts with the respective racks. Rack 87, additionally, is formed with a slot 870—see FIG. 3.

Bushings 88, 89, connected by axial bearings 881, 891 telescopically engage the racks 86, 87 for axial movement. The bushings 88, 89 terminate in spindle nut ends 882, 892, respectively, preferably having an acme thread, which engage in guide spindles 92, 93, axially fixedly retained in the bearing bushing 91, but rotatable with respect thereto. The bushings terminate in gears 94, 95 for connection to a suitable positioning motor—not further shown. Bearings 921, 931 are provided to journal the outer hollow portions of the guide spindles 92, 93, in which guide spindle 92 is supported in the bearing housing 90, and the guide spindle 93 within the spindle 92.

Adjustment operation: Gear 95, in engagement with spindle 93, operates the inner bushing 89 and hence the inner rack 86, in engagement with gear 861 which, in turn, is in engagement with the gear element 81. Gear 94, coupled to the spindle 92 and over bushing 88, is in engagement with the outer rack 87 and gear 871, acting on the wedge element 82.

The force of the gas springs 84, 85 associated with the wedge elements 81, 82 is greater than the force of the resulting axial components resulting from the torque transferred over the respective engagement surfaces 551, 731, 561, 641 and the rollers 55, 73, 56, 64, and the cone surfaces 811, 821 of the conical elements 81, 82, respectively. The force between the hollow cylindrical shaft 70 and the control arm 71 thereof and the creasing blade system F, or, respectively, its control disk 63 and the associated springs 81 are included therein.

The most common way of adjustment is to provide for central folding of the sheets. Since this is the most usual case, and to permit automatic readjustment of format with center folding, all angular adjustments are so made that, with the same cone angle, and upon the same adjustment time, the element 81 between the control arm 71 and the control disk 63 of the folding blade system F moves through twice the distance of the wedge element 82 between the control disk 53 of the gripper system G and the control disk 62 of the creasing blade system F upon respective opposite movement of the wedge elements 81, 82. The respectively opposite movement of the wedge elements 81, 82 can be obtained by suitable drive of the guide spindles 92, 93 and their gears 94, 95 in opposite direction, or by forming one of the threads as a right-hand thread and the other as a left-hand thread, that is, having opposite spiral inclination, or by suitable forming of the rack gearing on the respective housings 812, 822 of the wedge elements.

Operation, with reference and particularly by comparison of FIGS. 3 and 4: FIG. 3 illustrates the position of pick-up cylinder 2 in one end position, for the smallest format, and FIG. 4 the position of the cylinder for the largest format, or feed length, respectively. The illustrations of FIGS. 1, 2 and 5 correspond to the position of FIG. 3.

Upon adjustment, the wedge element 81 is in engagement with the roller 73 and, due to the force of spring 84, pivots the gripper system G by applying force of the housing 812, to permit rotation about the hollow shaft 54. Simultaneously, pressure is exerted on the roller 55 and hence on the control disk 53 so that the gripper system is rocked. The angle of rocking of the gripper system G will be twice as great as that of the wedge element 81 with a wedge element housing 812. Due to the movement—in FIG. 5 towards the left—of the wedge element 81, the gripper system G—FIG. 3—is pivoted towards the right and thus the gripper assembly 61 is adjusted to the front or leading edge of the sheet b. Pivoting of the gripper system G and of its control disk 53 is transferred over roller 56 and the wedge element 82 in the same direction of rotation. Since the wedge element 52 is, however, moved in opposite direction simultaneously with movement of the wedge element 81—and in the direction opposite to that of movement of wedge element 81—the above referred-to composite locking movement of the wedge element 81 in its housing will be in a direction opposite to the first rocking direction, the roller 64, and hence the control disk 63 of the folding blade apparatus F will follow with double the rocking distance. Gear 43, being rotatably fixed to the folding or creasing blade system F over the shaft 20, simultaneously so adjust the angular position of gear 32, with which the folding pick-up cylinder 3 is coupled, that the respective folding blade 61′ and the fold receiving groove 61 will always be in angularly matched adjusted position.

As can be seen, the wedge element positioning means 86, 87, 861, 867, adjust the position of the wedge elements 81, 82 with respect to the engaged camming surfaces, that is, on elements 81 the surfaces 551, 731 and element 82 the surfaces 561, 641, to thereby control the relative angular position of the gripper means G, 51, with respect to the drive shaft 70 and effect driving engagement of the drive shafts, and hence the drive means M, 41 with the gripper means G, 51 and with the first control disk 63 and with the central support shaft 20 and the sheet creasing and folding means F, 61, secured thereto.

The radial position of the wedge elements 81, 82 and the camming surfaces thereon, with respect to the axis of rotation of the central shaft 20, and the wedge angles of the wedge elements as well as the extent of movements of the respective wedge elements, per unit time, are relatively so adjusted and matched that the wedge element 81 positioned between the control arm 71 of the hollow shaft 70 and the control disk 63 of the creasing system F, 61 passes through twice or double the distance as the other wedge element 82, which is positioned between the first control disk 63 of the sheet creasing means, F, 61 and the second control disk 53 of the gripper means, G, 51.

As referred to above, adjustments can be done while the apparatus is in operation, simultaneously, or separately from each other, by suitable turning of the gears 94, 95 by positioning motors, or manually, thus permitting optimal correction while the system is being stopped. If the system is coupled to a rotary printing press, start-up, and acceleration of the printing press, and hence of the folding system, may require readjustment during transient conditions.

Gas or other compressible fluid springs are preferred in the apparatus since the applied resilient force is effectively uniform regardless of the length of extension of the spring and, overall, the system has excellent damping characteristics. Other force elements may be used, however. Due to the resilient force being applied to the wedges, any play in adjustment is eliminated. Changes in dimensional relations due to wear or abrasion of elements are automatically compensated and will not affect precise operation and adjustment of the apparatus; the only necessary adjustment would be a recalibration of indicator scales. The adjustment is precise and can accomodate small changes in size or format, and permit accurate fine adjustment. Thus, the accuracy of folding at a predetermined fold line—for example in the center of a sheet—over long operating times is insured. It is a specific advantage of the structure in accordance with the invention that the control elements which control the adjustment are outside of the elements which effect the adjustment, so that they can be independently controlled during operation and, further, that thus the actual adjustment elements are not subject to continuous wear or, in operation, cause additional noise or power loss.

It is particularly advantageous, in accordance with a feature of the invention, to form the respective engagement surfaces or rollers on the control arm and control disks, respectively, and the wedge and wedge surfaces on the positioning elements. A reverse positioning is possible, however, that is, to form wedge surfaces on the control arm and the control disks, respectively, and rollers on the positioning elements, engaging between the wedge surfaces. Various other changes and modifications within the scope of the inventive concept may be made.

Adjustment of the respective angular positions of the gripper systems and the folding or creasing blade system requires only minimum movement of the elements. This movement will occur only during readjustment. Once adjusted, no further changes are needed, and the system will then be stationary with respect to the drum. Thus, the respective parts are hardly subject to wear and, in operation, the adjustment system as such does not contribute to the operating noise of the machine. If creasing and folding is always to be carried out at a predetermined position with respect to the leading edge of the sheet, for example in the center thereof, then a single adjustment motor with oppositely directed threads on the guide bushings is sufficient. Providing two motors for engagement with the gears 94, 95, or permitting manual override, permits off-center folding, if such is desired.

The various parts require but little space so that the size of apparatus provided only for a fixed sheet length need not be increased, while permitting the flexibility of adjustment for sheet length. All adjustments are done at the side remote from the drive gears, thus increasing operating safety. The respective counter-directed movement of the wedge elements, with the arrangement so taken that adjustment of one of the systems is over twice the path length as the other, permits, without further structural elements, maintaining the position of the cutter blade of the cutter cylinder with respect to the pick-up cylinder regardless of length of format, which additionally contributes to operating simplicity and integration of the system with external printing and cutting apparatus.

I claim:

1. Sheet folding apparatus having a sheet pick-up cylinder (2);

a central shaft (20) supporting the sheet pick-up cylinder;

leading sheet edge gripper means (G, 51) positioned on the circumference of the sheet pick-up cylinder;

sheet creasing or folding means (61) positioned on the circumference of the sheet pick-up cylinder adjustably, circumferentially offset from the sheet gripper means;

a sheet receiving cylinder (3) having sheet fold receiving means (31) positioned to receive the sheet at a crease or fold line after creasing of the sheet by the sheet creasing means;

a drive means (M, 41);

and comprising, means (62, 63) for securing the sheet creasing means (F, 61) on the central shaft;

a drive shaft (70), coupled to the drive means (M, 41) positioned at an end portion of the central shaft and rotatable with respect to the central shaft;

means (52, 53, 54) including a hollow shaft (54) surrounding said central shaft (20) for securing the gripper means (G, 51) angularly adjustably on the central shaft (20);

a control arm (71) rotatably secured to the drive shaft (70) to rotate therewith and radially projecting therefrom and formed with a first camming surface (731);

a first control disk (63) secured to the central shaft (20) and formed with a second camming surface (641) positioned adjacent the control arm;

a second control disk (53) secured to the hollow shaft (54) which forms part of the gripper means securing means (52-54) and formed with third and fourth camming surfaces (551, 561) positioned adjacent said first control disk (63);

two selectively engageable wedge elements (81, 82), one of said wedge elements (81) being positioned between the first camming surface (731) and one (551) of the camming surfaces (551, 561) formed on the second control desk, the second wedge element (82) being positioned between the other of the camming surfaces (561) formed on the second control disk (53) and the second camming surface (641) of the first control disk (63);

and wedge element positioning means (86, 87, 861, 867) to adjust the position of the wedge elements (81, 82) with respect to the engaged camming surfaces (81: 551, 731; 82: 561, 641) to thereby control the relative angular position of the gripper means (G, 51) with respect to the drive shaft (70) and effect driving engagement of the drive shaft, and hence the drive means (M, 41) with the gripper means (G, 51) and with the first control disk (63) and hence with the central support shaft (20) and the sheet creasing and folding means (F, 61) secured thereto.

2. Apparatus according to claim 1, wherein said central shaft (20) and the drive shaft (70) are coaxial;

the camming surfaces are positioned radially spaced from the axis of rotation of said shafts;

and the engageable wedge elements engage between the respective camming surfaces to change the relative circumferential angular position of the camming surfaces and the support disks therefor, and hence of the gripper means (G, 51) and of the sheet creasing means (F61) with respect to an angular reference position of one of said shafts.

3. Apparatus according to claim 1, wherein said wedge elements comprise respectively projectable and retractable cones.

4. Apparatus according to claim 1, wherein the camming surfaces are defined by circumferential surfaces (551, 561, 641, 731) of rollers (55, 56, 64, 73) respectively secured to the control arm, and the first and the second control disks (63, 53).

5. Apparatus according to claim 4, wherein said wedge elements comprise respectively projectable and retractable cones insertable between respective surfaces of the rollers (55, 56, 64, 73).

6. Apparatus according to claim 4, wherein said wedge elements comprise respectively projectable and retractable cones insertable between respective surfaces of the rollers (55, 56, 64, 73), and wherein the wedge elements are movable in a direction parallel to the axis of rotation.

7. Apparatus according to claim 1, further comprising resilient force means (83) coupled between the control arm (71) and one of said control disks (63) and tending to move the camming surfaces towards each other to permit spreading of the camming surfaces upon penetration of the wedge elements between adjacent camming surfaces under application of a penetrating force.

8. Apparatus according to claim 7, wherein said penetrating force includes a gas spring.

9. Apparatus according to claim 1, wherein at least one of the wedge elements comprises a housing (812, 922) positioned parallel to the axis of rotation of the central shaft (20) and axially spaced therefrom, and retained in position to rotate, over a limited angular extent, with respect to the central shaft;

the wedge elements comprising cone elements secured within said housing.

10. Apparatus according to claim 1, wherein the sheet gripper securing means (52, 54) comprises a pair of disks (52, 53) secured to said hollow shaft (54).

11. Apparatus according to claim 10, wherein one of said disks (53) simultaneously forms the second control disk (53) formed with the third and fourth camming surfaces (551, 561).

12. Apparatus according to claim 1, wherein the sheet creasing means securing means (62, 63) comprises two axially spaced disks secured to the central shaft (20).

13. Apparatus according to claim 12, wherein one of the disks (63) securing the sheet creasing means simultaneously forms the control disk formed with the second camming surface (641).

14. Apparatus according to claim 13, further including a gas spring (83) pivotally attached to the control arm (71) and to the first control disk (63) to resiliently connect the control arm and the first control disk while permitting relative circumferential adjustment of the control arm and the control disk about the axis of rotation of the central shaft (20), said gas spring being positioned in a plane essentially perpendicular to said axis of rotation.

15. Apparatus according to claim 1, wherein the central shaft (20) is formed with an internal bore (21);

two independently longitudinally adjustable racks (86, 87) positioned in said bore (21);

rack portions (815, 825) positioned on the wedge elements (81, 82);

and connecting gear means (861, 871) connecting a respective rack (86, 87) with a respective rack element (815, 825) of a respective wedge element;

and means (88, 89) adjustably positioning the racks in longitudinal direction with said bore, movement of said racks within said bore being transmitted over the gear means to the wedge elements to move said wedge elements inwardly and outwardly, respectively, between the respectively engaged camming surfaces.

16. Apparatus according to claim 15, wherein the wedge elements (81, 82) are radially spaced from the axis of rotation of the central shaft (20) and include axially directed spring means (84, 85);

holder means (813, 823) supporting said spring means in force receiving relationship, and conically projecting elements urged by said spring means between the respective camming surfaces (551, 561, 641, 731) on the control arm (71) and the control disks (53, 63) forming the wedge elements.

17. Apparatus according to claim 16, further including axially adjustable bushings or sleeves (88, 89) coupled to said racks.

18. Apparatus according to claim 15, wherein one of said racks is a hollow cylindrical element (87) positioned in the bore (21) of the central shaft (20), and formed with a radially positioned slot (870);

the other rack (86) comprises a cylindrical element positioned within the hollow first cylindrical rack (87), the gear means (861) engaging the inner rack (87) and the respective wedge elements being positioned in said slot and fitting through the first, hollow rack (86), the respective racks being telescoped within each other and relatively movable;

the adjustment means including axially movable sleeves or bushings (88, 89) telescoped within each other, the outer one (88) of the sleeves or bushings being coupled to the outer rack (87), and the inner one of the sleeves or bushings (89) being coupled to the inner rack (86);

axial adjustment spindle nuts (92, 93) engaged with said bushings in threaded engagement, and adjustment control wheels (94, 95) coupled to the respective spindle nuts (92, 93).

19. Apparatus according to claim 1, further comprising spring means (84, 85) urging the wedge elements (81, 82) in position between said camming surfaces;

and wherein the spring force of said spring means is greater than the resulting axial components of the force due to the torque being transferred between the camming surfaces (551, 731; 561, 641) and the inclined wedge surfaces (811, 821) of the wedge elements (81, 82) including the force of power transfer between the hollow shaft (70) and the control arm (71) secured thereto to the first control disk (63) and the sheet creasing or folding means (F, 61) secured thereto.

20. Apparatus according to claim 1, further including a drive gear (43) secured to the central shaft (20), said drive gear positively and synchronously driving said sheet receiving cylinder (3).

21. Apparatus according to claim 1 wherein the wedge element positioning means include means (84, 85, 86, 87, 88, 89, 92, 93, 94, 95) for controllably axially moving said wedge elements (81, 82);

said controllable moving means being coupled to said wedge elements for movement of said wedge elements in opposite directions to provide for penetration of said wedge element between the respective camming surfaces, while withdrawing the other wedge element from between the other respective camming surfaces;

and wherein the radial position of said wedge elements (81, 82) and the respective camming surfaces associated therewith—with respect to the axis of rotation of said central shaft (20)—as well as the angles of inclination of the wedge surfaces of the wedge elements are relatively so dimensioned that, upon movement of said controllable moving means, that one (81) of the wedge elements positioned between the control arm (71) of the hollow shaft (70) and the first control disk (63) moves through double the distance as the wedge element (82) positioned between the first control disk (63) and the second control disk (53).

22. Apparatus according to claim 21, wherein the wedge elements are cones of equal cone angle.

* * * * *